US007014015B2

(12) United States Patent
Nikovski et al.

(10) Patent No.: US 7,014,015 B2
(45) Date of Patent: Mar. 21, 2006

(54) METHOD AND SYSTEM FOR SCHEDULING CARS IN ELEVATOR SYSTEMS CONSIDERING EXISTING AND FUTURE PASSENGERS

(75) Inventors: Daniel N. Nikovski, Somerville, MA (US); Matthew E. Brand, Newton, MA (US)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 162 days.

(21) Appl. No.: 10/602,849

(22) Filed: Jun. 24, 2003

(65) Prior Publication Data

US 2004/0262089 A1 Dec. 30, 2004

(51) Int. Cl.
*B66B 1/18* (2006.01)

(52) U.S. Cl. ..... 187/382; 187/247

(58) Field of Classification Search ..... 187/380–389, 187/247, 248

See application file for complete search history.

(56) References Cited

U.S. PATENT DOCUMENTS

| | | | | |
|---|---|---|---|---|
| 4,244,450 | A * | 1/1981 | Umeda et al. | 187/382 |
| 4,458,787 | A * | 7/1984 | Uetani | 187/387 |
| 4,669,579 | A * | 6/1987 | Ookubo | 187/382 |
| 4,982,817 | A * | 1/1991 | Tsuji | 187/387 |
| 5,058,711 | A * | 10/1991 | Tsuji | 187/383 |
| 5,146,053 | A | 9/1992 | Powell et al. | 187/127 |
| 6,173,816 | B1 * | 1/2001 | Barker et al. | 187/382 |
| 6,394,232 | B1 * | 5/2002 | Iwata et al. | 187/382 |
| 6,401,874 | B1 * | 6/2002 | Siikonen | 187/382 |
| 6,672,431 | B1 * | 1/2004 | Brand et al. | 187/382 |
| 6,808,049 | B1 * | 10/2004 | Brand et al. | 187/383 |
| 2001/0002636 | A1 * | 6/2001 | Siikonen | 187/382 |

OTHER PUBLICATIONS

Barney, "*Elevator Traffic Handbook*," Spon Press, London, 2003, pp. 269-270.

Strakosch, "*Vertical transportation: elevators and escalators*," John Wiley & Sons, Inc., 1998, pp. 150-151.

Bao, "*Elevator dispatchers for down-peak traffic*," Technical Report, University of Massachusetts, Department of Electrical and Computer Engineering, Amherst, Massachusetts, 1994.

Nikovski et al., "*Decision-theoretic group elevator scheduling*," 13th International Conference on Automated Planning and Scheduling, Trento, Italy, Jun. 2003.

Ujihara et al., "*The revolutionary AI-2000 elevator group-control system and the new intelligent option series*," Mitsubishi Electric Advance 45:5-8, 1988.

Crites et al., "*Elevator group control using multiple reinforcement learning agents*," Machine Learning, 33:235, 1998.

(Continued)

*Primary Examiner*—Jonathan Salata
(74) *Attorney, Agent, or Firm*—Dirk Brinkman; Andrew J. Curtin

(57) ABSTRACT

A method schedules cars of an elevator system in a building. The method begins execution whenever a newly arrived passenger presses an up or down button to generate a call for service. For each car, determine a first waiting time for all existing passengers if the car is assigned to service the call, based on future states of the elevator system. For each car, determine a second waiting time of future passengers if the car is assigned to service the call, based on a landing pattern of the cars. For each car, combine the first and second waiting times to produce an adjusted waiting time, The method ends by assigning a particular car having a lowest adjusted waiting time to service the call and minimize an average waiting time of all passengers.

13 Claims, 3 Drawing Sheets

OTHER PUBLICATIONS

Bertsekas, "*Dynamic Programming and Optimal Control,*" *Athena Scientific*, Belmont, Massachusetts, 2000. vols. 2, pp. 261-264.

Bertsekas, "*Dynamic Programming and Optimal Control*," Athena Scientific, Belmont, Massachusetts, 2000, vols. 1, pp. 18-24.

* cited by examiner

200

Future States
209
Determine Waiting Time for Existing Passengers
210
Each Car
202
Determine Waiting Time for Future Passengers
220
Landing Pattern
219
Call
201
1st Waiting Time
211
2nd Waiting Time
221
Combine
230
Adjusted Waiting Time
231
Assign Car
240

300

METHOD AND SYSTEM FOR SCHEDULING CARS IN ELEVATOR SYSTEMS CONSIDERING EXISTING AND FUTURE PASSENGERS

FIELD OF THE INVENTION

This invention relates generally to scheduling elevator cars, and more particularly to elevator scheduling methods that consider future passengers.

BACKGROUND OF THE INVENTION

Scheduling elevators in a large building is a well-known hard industrial problem. The problem is characterized by very large state spaces and significant uncertainty, see Barney, "*Elevator Traffic Handbook*," Spon Press, London, 2003. Typically, a passenger requests elevator service by pressing a call button. This causes the elevator scheduler to assign an elevator car to service the passenger.

The earliest elevator schedulers used the principle of collective group control. In this heuristic, the nearest car, in its current direction of travel, is assigned to service the passenger, see Strakosch, "*Vertical transportation: elevators and escalators*," John Wiley & Sons, Inc., 1998. Such scheduling is sub-optimal and unpredictable. For this reason, collective control is unacceptable when passengers expect to be notified about which car will pick them up, immediately after the call is made.

Another heuristic minimizes a remaining response time (RRT) for each passenger. The RRT defines the time it takes to pick up each passenger as prescribed by the current schedule, see U.S. Pat. No. 5,146,053, "Elevator dispatching based on remaining response time," issued to Powell et al., on Sep. 8, 1992. That heuristic focuses only on minimization the waiting time of passengers, and ignores altogether the effect of the current assignment on the waiting times of future passengers.

Within RRT-based minimization, a further distinction can be made between those methods that ignore the uncertainty associated with the desired destination floors of passengers, see Bao, "*Elevator dispatchers for down-peak traffic*," Technical Report, University of Massachusetts, Department of Electrical and Computer Engineering, Amherst, Mass., 1994, and those that properly determine the expected RRT of each passenger with respect to destinations, see Nikovski et al., "*Decision-theoretic group elevator scheduling,*" $13^{th}$ International Conference on Automated Planning and Scheduling, Trento, Italy, June 2003, and U.S. patent application Ser. No. 10/161,304 "Method and System for Dynamic Programming of Elevators for Optimal Group Elevator Control," filed by Brand et al. on Jun. 3, 2002, incorporated herein by reference.

However, the uncertainty associated with future passengers is entirely new matter for at least two reasons. Accounting properly for the effect of the current decision on the waiting times of all future passengers is an extremely complicated problem, First, the uncertainty associated with future passengers is much higher because the arrival time, the arrival floor, and the destination floor are all unknown. Second, the current decision potentially influences the waiting times of passengers arbitrarily far into the future, which makes the theoretical optimization horizon of the problem infinite.

In spite of the computational difficulties, ignoring future passengers often leads to sub-optimal scheduling results. The current assignment affects the future movement of the cars, and influences their ability to serve future calls in the minimal amount of time.

One particular situation that exemplifies the importance of future passengers is peak traffic. During down-peak traffic periods, for example, at or near the end of the workday, most future passengers select the main floor as their destination. Because these future passengers are most likely distributed over upper floors, scheduling for down-peak traffic is a very hard problem.

During up-peak traffic periods, most future passengers arrive at the main floor and request service to upper floors. Typically, the up-peak period is much shorter, busier and concentrated than the down-peak period. Therefore, up-peak throughput is usually the limiting factor that determines whether an elevator system is adequate for a building. Therefore, optimizing the scheduling process for up-peak traffic is important.

Consider the following scenario. A call is made at some upper floor. A single car is parked at the main floor, and the scheduler decides to serve the call with that car, based only on the projected waiting times of passengers. If the car at the main floor car is dispatched to serve the call, the main floor remains uncovered and future passengers will have to wait much longer than if the car had stayed. This shortsighted decision, commonly seen in conventional schedulers has an especially severe impact during up-peak traffic, because the main floor quickly fills with many waiting passengers, while the car services the lone passenger above.

Several elevator scheduling methods are known for considering future passengers, with varying success. Some schedulers use fuzzy rules to identify situations similar to the one discussed above and make decisions that are more sensitive to future events, see Ujihara et al., "*The revolutionary AI-*2000 *elevator group-control system and the new intelligent option series*," Mitsubishi Electric Advance, 45:5–8, 1988. However, that method has major disadvantages. First, the rules need to be coded manually. Therefore, the system is only as good as the 'expert'. Second the interpretation of fuzzy-rule inferences between the rules often behaves erratically, particularly when there is no applicable rule for some specific situation. Thus, the elevators often operate in an unintended and erratic manner.

Another method recognizes that group elevator scheduling is a sequential decision making problem. That method uses the Q-learning algorithm to asynchronously update all future states of the elevator system, see Crites et al., "*Elevator group control using multiple reinforcement learning agents*," Machine Learning, 33:235, 1998. They dealt with the huge state space of the system by means of a neural network, which approximated the costs of all future states. Their approach shows significant promise. However, its computational demands render it completely impractical for commercial systems. It takes about 60,000 hours of simulated elevator operation for the method to converge for a single traffic profile, and the resulting reduction of waiting time with respect to other much faster algorithms was only 2.65%, which does not justify its computational costs.

The prior art methods are either labor-intensive or computationally expensive or both. Therefore, there is a need for a method that optimally schedules elevator cars, while taking future passengers into consideration, particularly for up-peak traffic intervals.

Summary of the Invention

DETAILED DESCRIPTION OF THE PREFERRED EMBODIMENT

System Structure

Figure 1:
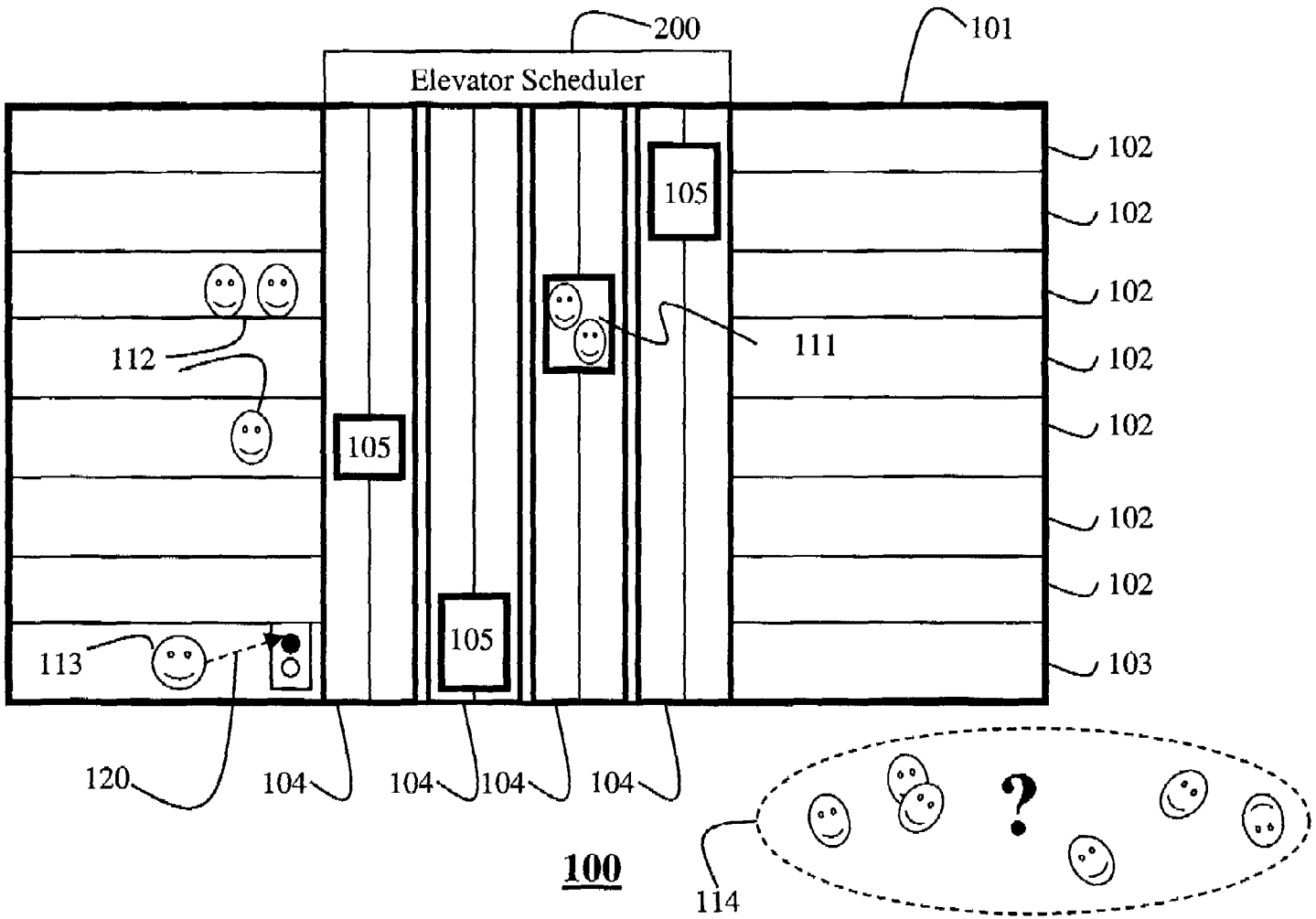
FIG. 1 is a block diagram of an elevator system that uses the invention.

FIG. 1 shows an elevator scheduler 200 according to our invention for a building 101 with upper floors 102, a main floor 103, elevator shafts 104, elevator cars 105. The main floor is often the ground or lobby floor, in other words the floor where most passengers entering the building mainly arrive.

For the purpose of our invention, passengers are formally classified into several classes according to variables that describe what is known about the passengers. The variables introduce uncertainty into the decision-making process of the elevator scheduler. The classes are riding, waiting, new and future passengers.

For each riding passenger 111, the arrival time, the arrival floor, and the destination floor are all known. The riding passengers are in cars, and no longer waiting.

For each waiting passengers 112, the arrival time, the arrival floor, and the direction of travel are known. The destination floor is not known. A car has been assigned to service each waiting passenger.

For a new passenger 113, the arrival time, the arrival floor, and the direction of travel are known because the new passenger has signaled 120 a call. The general problem is to assign a car to service the call of the new passenger. At any one time, there is only one new passenger.

The above three classes of passengers 111–113 are collectively existing passengers. The reason we call these passenger existing is because they have already arrived physically, and the system knows something about all of these passengers. Of the existing passengers, only the waiting passengers and the new passenger have non-zero waiting times.

For future passengers 114, who do not exist yet, nothing is known. At best, the passenger variables can be described stochastically by random variables, or be estimated from past data. All passengers include existing and future passengers.

The specific problem is to assign a car to service the new passenger so that the expected waiting time for all passengers, existing and future, is minimized.

Method of Operation

Figure 2:
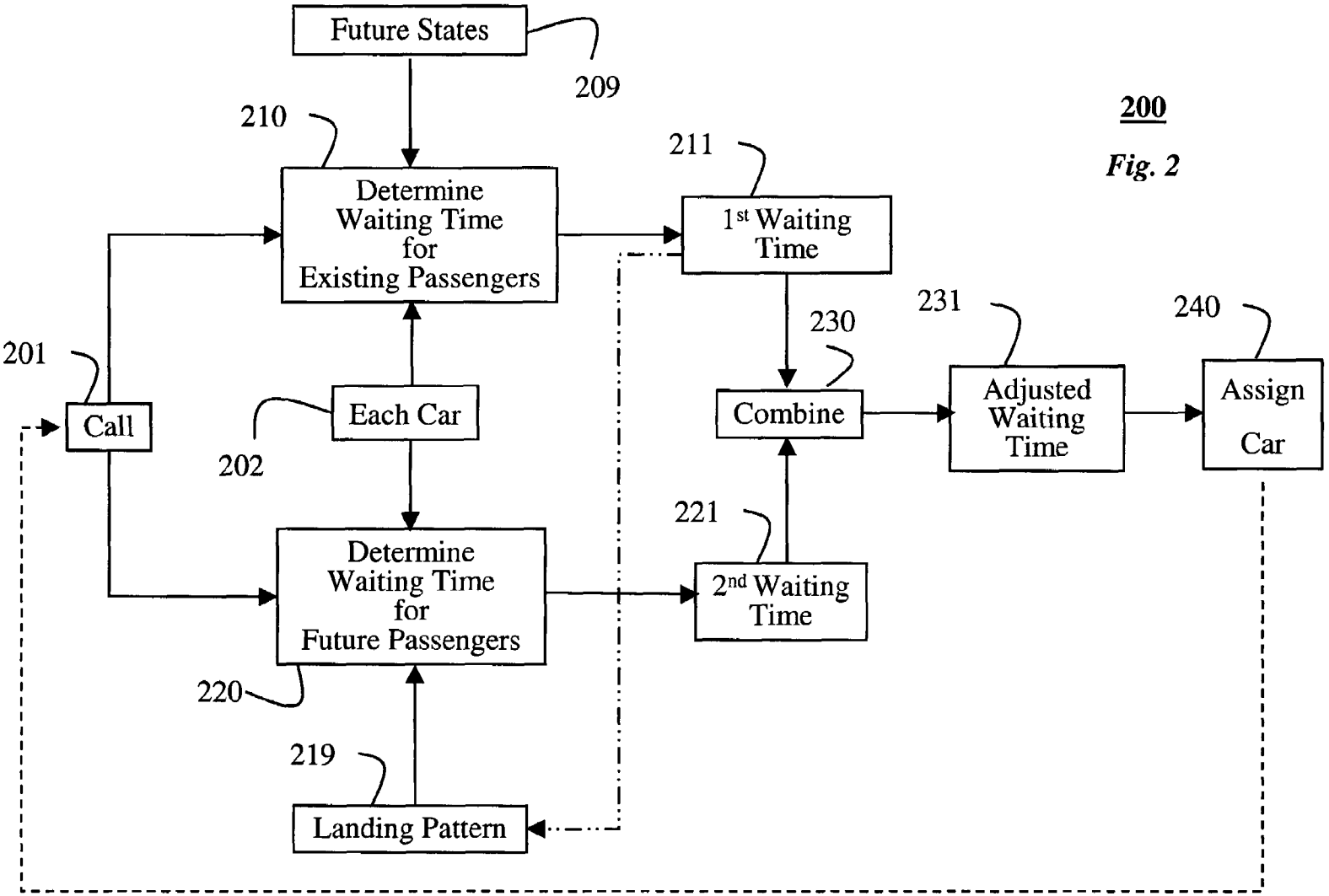
FIG. 2 is a flow diagram of a method for scheduling elevator cars according to the invention.

FIG. 2 shows a method for scheduling cars of the elevator system 100 according to the invention. The method 100 executes in response to a call 201. The call can be any floor. First, the scheduler 200 determines, for each car, based on future states 209 of the elevator system, a first expected waiting time 211 for all existing passengers 111–113 if the car is assigned to service the call. Second, the scheduler determines, for each car based on a landing pattern 219 of the cars 105, a second expected waiting time 221 of the future passengers 114 if the car is assigned to service the call 102. For each car, the first and second expected waiting times are combined 230 to produce an adjusted waiting time 231, and the car with the lowest adjusted waiting time is assigned 240 to service the call 201.

Ideally, the elevator scheduler would determine the marginal costs of all possible assignments, with all sources of uncertainty integrated out, before making an assignment. However, due to the insurmountable computational complexity of the scheduling problem, the vast majority of commercial elevator schedulers typically resort to heuristic methods that ignore some or all of this uncertainty.

In typical up-peak traffic periods, a substantial number of future passengers, e.g., between 80% and 95%, arrive at the main floor. The waiting times of these main floor arrivals is the dominant component in the overall waiting time of an elevator system during up-peak traffic periods, and the current decision of an elevator scheduler should attempt to minimize the expected waiting time of passengers at the main floor.

Hence, we begin with a simplifying assumption that all future passengers arrive at the main floor. The effect of not modeling future arrivals at other floors shortens the time-horizon in which predicted waits are accurate to the near future. However, this effect is explicitly worked into the calculations later, as a discounting factor. In addition, for up-peak traffic periods, most future passengers do in fact arrive at the main floor.

With this assumption, the current decision of the elevator scheduler affects the waiting times of future passengers through the future arrival of cars at the main floor. We call this sequence of arrivals of the cars at the main floor the landing pattern.

For the purpose of the invention, the landing pattern 219 of cars at the main floor is determined by the following factors. First, riding passengers at upper floors can select the main floor as their destination. Second, empty cars can automatically select the main floor as the place to park while waiting for a next call. Determining the landing pattern 219 effectively marginalizes out individual future passengers 214.

Optimal parking strategies and their effects on the landing pattern are described in U.S. patent application Ser. No. 10/293,520 "Optimal Parking of Free Cars in Elevator Group Control," filed by Brand et al., on Nov. 13, 2002, incorporated herein by reference.

One strategy to service main floor passengers preferentially is to send each car to the main floor immediately after it has completed servicing the last riding passenger. For a building with C cars, a landing pattern 219 is an array of times $$T=[T_1, T_2, \ldots, T_C], \text{ for } T_j \geqq 0,$$

where $T_j$ is the arrival time of car j=1, . . . , C at the main floor after it has delivered all of its riding passengers.

Because there is uncertainty about the destinations of the waiting passengers 112 and the new passenger 113, the landing pattern T is a vector-valued random variable with a probability distribution P(T), $T \in T$ over the space of all possible landing patterns T 219.

Ideally, the scheduler 200 should determine an expected waiting time V(T) for each possible landing pattern $T \in T$, and take the expectation of that time with respect to the probability distribution P(T) as $\langle P(T) \rangle = \int_{T \in T} P(T)V(T)dT$.

Here < > denotes the expectation operator. Indeed, this is an exact estimate of the waiting times of main floor passengers, under the above assumption that all new passenger arrivals are at the main floor. However, there is no practical way to determine the probability distribution P(T). Even if there was, the size of the space of all possible landing patterns is huge. Integrating over this space is computationally impractical.

Instead, we use a substitute landing pattern including individual expected arrival times at the main floor of each car $\bar{T}=[\bar{T}_1, \bar{T}_2, \ldots, \bar{T}_C]=[<T_1>, <T_2>, \ldots, <T_C>]$, and use an approximation $<V(T)\approx V(<T>)=V(\bar{T})$. Note that the equality $<T>=\bar{T}$ is true because each of the components $T_j$, for j=1, . . . , C, is an independent random variable whose uncertainty depends only on the probability distribution over the destinations of riding and waiting passengers assigned to car j.

For the same reason, this approximation is quite good on average. The exact landing time of each car $\bar{T}_i$ depends, of course, on earlier assignments made to existing passengers, and their uncertain destinations. In other words, the landing pattern depends indirectly on the expected waiting time 211 of the existing passengers 111–113. A method for determining 210 the expected waiting time 211 of existing passengers 111–114 is described by Nikovski et al., in "*Decision-theoretic group elevator scheduling,*" 13$^{th}$ International Conference on Automated Planning and Scheduling, June 2003, and U.S. patent application Ser. No. 10/161,304 "Method and System for Dynamic Programming of Elevators for Optimal Group Elevator Control," filed by Brand et al. on Jun. 3, 2002, incorporated herein by reference. For short, this method is referred to as the "Empty the System Algorithm by Dynamic Programming" (ESA-DP) method.

So far we have considered the parking pattern T and $\bar{T}$ as functions of a fixed existing assignment of passengers to cars. However, a current decision of the scheduler 200, i.e., which car should be assigned to service the new passenger 113, changes this assignment. Because the scheduler can select any one of C cars, there are C possible resulting assignments, and hence, C possible distributions of the landing pattern 219. If we use the above approximation, then we need the landing pattern $\bar{T}(i)=[\bar{T}_{i1}, \bar{T}_{i2}, \ldots, \bar{T}_{iC}]$, for i=1, . . . , C, which occurs when the new passenger 113 is assigned to car i. The meaning of each entry $\bar{T}_{ij}$ is the expected landing time of car j when the new passenger 113 is assigned to car i.

After the matrix for the landing pattern 219 for the C cars has been built, the expected cumulative waiting time 221 of future passengers 214 corresponding to each of the landing pattern, i.e., rows of the matrix, can be determined.

We provide a procedure for determining an expected waiting time of future passengers 214 as a function of any landing pattern 219 $T=[T_1, T_2, \ldots, T_C]$.

Because the waiting time 221 of the future passengers 214 is invariant with respect to the particular order of car arrivals, i.e., it makes no difference whether car "2" arrives in ten seconds and car "3" arrives in fifty seconds, or vice versa. We sort the landing pattern T 219 in an ascending order: $0\leqq T_1\leqq T_2\leqq \ldots T_C$. With this assumption, we define $V^0(T)$ as the expected cumulative waiting time 221 of all future passengers 114 within the time interval $t\in[0, T_C]$: $V^0(T)=\int_0^{T_C} n(t)dt$, where n(t) is the expected number of passengers waiting at the main floor 103 at time t.

Before describing our car assignment procedure, we introduce exponential discounting of future waiting times 221 because of a bias in the predicted parking times of the cars. The bias is due to our approximating assumption that no future arrivals above the main floor occur before the end of the current landing pattern.

In practice, such future arrivals do occur, albeit infrequently. These passengers will be assigned to cars with riding and waiting passengers. Those cars are then delayed in reaching the main floor. Thus the landing times estimated by the ESA-DP process may underestimate slightly the actual times for near future predictions, and, perhaps, significantly for far-future predictions.

The near future can be defined as the average time it takes a car to make a round trip from the main floor and back, for example 40–60 seconds for a medium sized building. This time is computable.

One way to discount estimates far into the future is to multiply the estimates by $\exp(-\beta t)$, where $\beta>0$ is a discounting factor.

Similarly to the case above, we define the expected discounted cumulative waiting time of future passengers to be $V\beta(T)=\int_0^{T_C} e^{-\beta t} n(t)dt$. The interval $[0, T_C]$ can be split into C different intervals $[T_{i-1}, T_i]$, for i=1, . . . , C, setting $T_0=0$. The expected number of passengers waiting at time $t\in[T_{i-1}, T_i]$ is proportional to the time elapsed since the last time a car landed at the main floor was $(T_{i-1})$.

If we model the arrival of future passengers 114 as a Poisson process with a rate λ, then the expected number of passengers at the main floor is $n(t)=\lambda(t-T_{i-1})$, and the integral above splits into C parts that can be evaluated. We assume that the cars can pick up all passengers waiting at the main floor instantaneously, because loading times are small relative to waiting times.

However, if car i reaches the main floor and finds it empty, then it does not depart immediately at its arrival time $T_i$. Instead, the car waits at the main floor until a future passenger 114 turns into the new passenger 113 on signaling 120 a call. If there are j cars at the main floor at time t=0, then the first j passengers do not wait at all. Each passenger boards a car immediately, with no waiting time. The significant but speculative savings in this scenario are balanced against a real cost of not using those cars to service a new passenger at an upper floor. In order to quantify these savings, the elevator cars at the main floor are modeled accurately.

Semi-Markov Model

To correctly estimate the waiting time 221 of future passengers 214, given the actual behavior of cars when nobody is waiting at the main floor, we employ a semi-Markov chain whose states and transitions describe the behavior of cars landing at the main floor.

A semi-Markov chain includes a finite number of states $S_i$, i=1, . . . , $N_S$, average momentary costs $i_{ij}$, expected transition times $\tau_{ij}$, probabilities $P_{ij}$ of the transitions between each pair of states $S_i$ and $S_j$, and an initial distribution $\pi(S_i)$, which specifies the probability that the system starts in state $S_i$, see Bertsekas, "*Dynamic Programming and Optimal Control,*" Athena Scientific, Belmont, Mass., 2000. Volumes 2, pages 261–264. Furthermore, each semi-Markov chain contains an embedded fully-Markov chain evolving in discrete time, whose cumulative transition costs $R_{ij}$ are defined as $R_{ij}=\tau_{ij}r_{ij}$, and all transitions are assumed to occur within a unit of time. The states in the semi-Markov chain used for our problem are labeled by the triple (i, j, m), where i is the number of cars yet to land at the main floor, j is the number of cars parked currently at the main floor waiting for passengers, and m=C−i−j is the number of cars already departed from the main floor.

Figure 3:
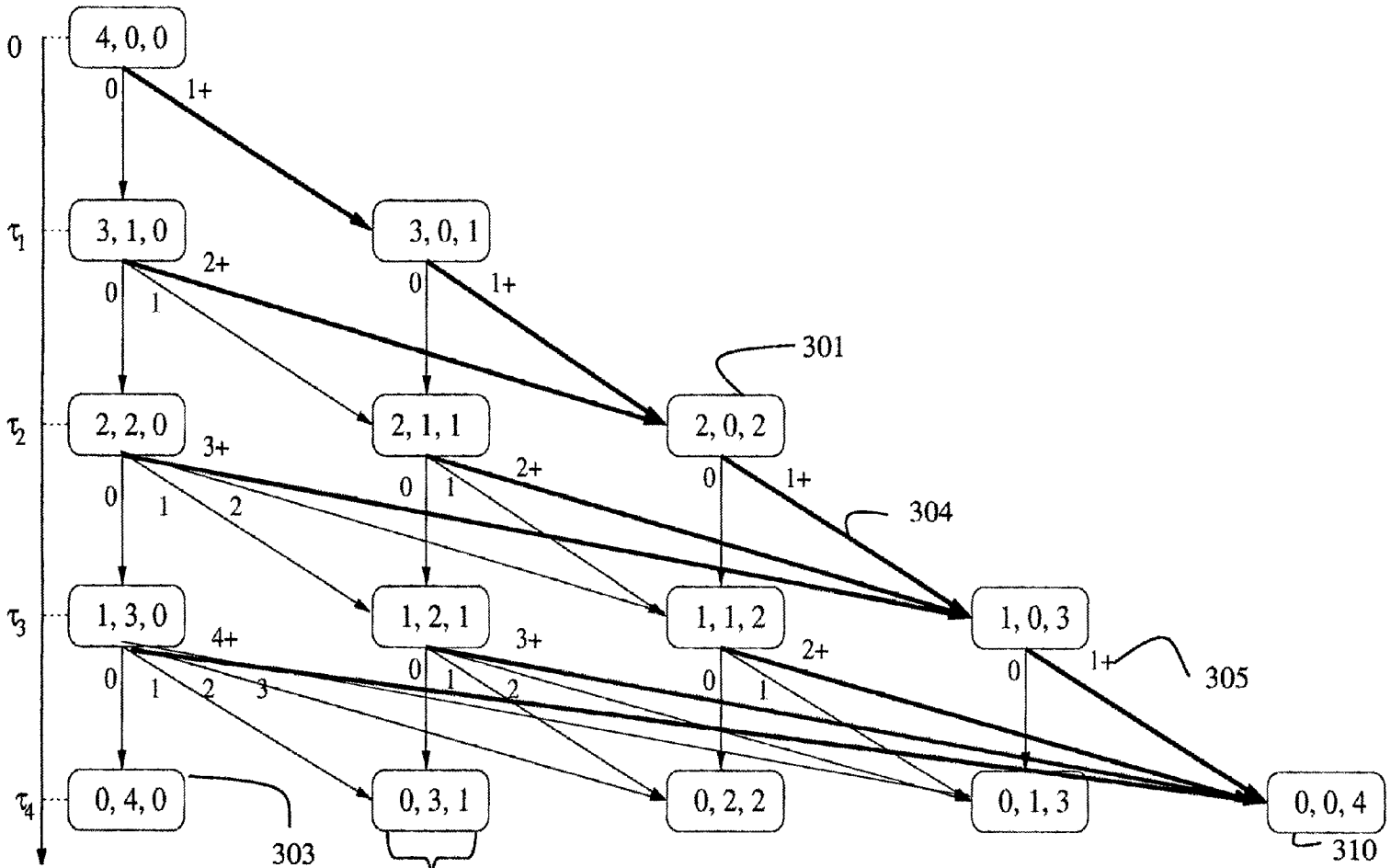
FIG. 3 is a grid showing Markov chains according to the invention.

As shown in FIG. 3, we organize the states of the semi-Markov chain in a two-dimensional grid or matrix. Each element $S_{im}$ 301 in the matrix 300 corresponds to a state (i, j, m). The grid structure in FIG. 3 is for an embedded semi-Markov chain for a building with four shafts. Row 302 i of the model contains all possible states of the system just after car i has arrived at time $T_i$ and has picked up all passengers that might have been waiting at the main floor. Note that the vertical time axis 303 is not drawn to scale. Only transitions shown in bold arrows 304 have non-zero costs. The cost of all other transitions is zero. Transitions labeled with n+ 305 for some number n are taken when n or more passengers arrive.

First, we provide a solution for the generic situation represented by this model, namely when no cars are parked at the main floor at the current decision time ($T_1>0$), and later extend the solution to the case when some cars are parked at the main floor.

For the generic case, the starting state of the chain is a state (C, 0, 0), i.e., all C cars are yet to land at the main floor. The terminal states are those in the bottom row of the model, when all C cars have landed, and depending on how many of the future passengers have arrived in the interval $t\in[0, T_C]$. Either all cars have departed with passengers on board, i.e., state (0, 0, C) 210, or some cars are still present at the main floor, i.e., states (0, j, C−j) for some j>0.

Each state (i, j, m) in the rows above the bottom one (i>0), where j=C−i−m, can transition to two or more successor states. This depends exactly on how many future passengers arrive during a time interval $t\in[T_i, T_{i+1}]$. For example, the chain transitions from state (4, 0, 0) to state (3, 1, 0) only when no passengers arrive by time $T_1$, and transitions to state (3, 0, 1) when one or more passengers arrive by that time. Each of the transitions in FIG. 3 is labeled with the number of passengers that should arrive when this transition is taken.

The time to complete each transition is readily determined to be the interval $\Delta T_i=T_i-T_{i-1}$ between the arrival of two cars. The probability of each transition can also be determined because the transition is equal to the probability that a particular number of future passengers arrive within a fixed interval from a Poisson process with arrival rate λ. Thus, the probability p(x) that exactly x passengers arrive in time $\Delta T_i$ is $p(x)=(\lambda\Delta T_i)^x e^{-\lambda\Delta T_i}/x!$. For transitions labeled with an exact number of arriving passengers, this formula can be used directly. For transitions labeled with n+, meaning that they are taken when n or more new passengers arrive, the probability of the transition is one minus the sum of the probabilities of all remaining outgoing transitions from this state:

$$p(n+) = 1 - \sum_{x=0}^{n-1} p(x).$$

Determining the cost of transitions labeled with an exact number of passengers is straightforward because the number of arriving passengers is less than or equal to the number of cars parked at the main floor. None of these passengers has to wait, and the cost of the corresponding transitions is zero. However, determining the cost of the last or rightmost transition from each state is quite involved. Such a transition corresponds to the case when n or more passengers arrive at the main floor, while only n−1 cars are parked there. The computation has to account for the fact that if x future passengers arrive, and x≦n, the first n−1 of passengers take a car and depart without waiting, and only the remaining x−n+1 passengers have to wait.

FIG. 3 shows that for any state $S_{im}$ of the grid, as defined above and j=C−i−m, the transition shown in bold is taken when more than j future passengers arrive, i.e., n=j−1. Hence, if that transition is taken and x future passengers arrive, then only the last x−j passengers have to wait. In other words, if x passengers appear within some time t, the differential or momentary cost $r_{im}$ at that time is x−j.

Because such a transition covers the case when some number of passengers greater than j appear, and this number can theoretically be arbitrarily large, even in a finite time interval, the expected cost of the transition is a weighted sum over all possible numbers of arrivals x, from j+1 to infinity, and the weights are the probabilities that x arrivals occur, as given by the Poisson distribution.

In addition, the differential costs at time t can be discounted by a factor of exp(−βt), as described above. This reasoning yields the following expression for the expected discounted cumulative waiting time $R\beta_{im}$ of main floor passengers during the last transition out of state $S_{im}$, with j=C−i−m:

$$R_{im}^{\beta} = \int_{T_{C-i}}^{T_{C-i+1}} e^{-\beta t} \sum_{x=j+1}^{\infty} \frac{[\lambda(t-T_{C-i})]^x e^{-\lambda(t-T_{C-i})}}{x!}(x-j)\,dt.$$

After a change of integration variables, simplification, and splitting of the integral into two parts according to the two components of the difference between x−j, the expression for the cost evaluates to $R\beta_{im}=e^{-\beta T_{C-i}}[F(\Delta T_{C-i+1})-F(0)]$, making use of a function $$F(t) = \sum_{x=0}^{j} \lambda^x e^{-(\lambda+\beta)t}(x-j)\sum_{l=0}^{x} \frac{t^{x-l}}{(x-l)!\,(\lambda+\beta)^{l+1}} + \frac{(\beta j-\beta\lambda t-\lambda)e^{-\beta t}}{\beta^2} + c_0$$

for some arbitrary, but fixed integration constant $c_0$, which we set to zero for convenience.

After all costs and probabilities of the semi-Markov model have been determined as described above, the cumulative cost of waiting incurred by the system when it starts in any of the model states can be determined efficiently by means of dynamic programming, starting from the bottom row of the model and working upwards, see Bertsekas, "*Dynamic Programming and Optimal Control*," Athena Scientific, Belmont, Mass., 2000, Volumes 1, pages 18–24. Because the states in the bottom row are terminal and mark the end of the landing pattern, we set their waiting times to zero, i.e., we are not interested in the amount of waiting time accumulated after the last landing.

After the waiting times for all states are determined, we can obtain the cumulative waiting time for the entire pattern T from the initial state of the model. In the generic case, if there are no cars at the main floor at time t=0, then the initial state is always (C, 0, 0). The special case, when one or more cars are parked at the main floor at time t=0, can be handled just as easily. In this special case, the starting state is (C−1, 1, 0), where 1 is the number of cars at the main floor, and the expected discounted cumulative wait for the entire pattern is the waiting time of this starting state ($S_{C-1,0}$). This eliminates the need to handle this special case separately from the generic one.

The procedure described above provides estimates $V_i\beta=V\beta(T_i)$ of the expected cumulative discounted waiting time 221 of future passengers 114, based on each of the landing pattern $T_i$ 219 resulting from the decision to assign the current call 201 to car i, i=1 . . . C. Simultaneously, the ESA-DP process in step 210 determines estimates $W_i$ of the cumulative non-discounted waiting time 211 of the existing passengers 211–213, including the new passenger 213 that signaled the call 201, when the call is assigned 230 to car i, i=1, . . . , C.

In order to arrive at an optimal decision that balances the wait 211 of existing passengers and the wait 221 of future passengers, the two sets of values $V_i\beta$ and $W_i$ are combined 230 to determine the adjusted waiting time 231.

There are significant differences between these two measures: The cumulative waiting time 211 of passengers $W_i$, i.e. waiting 112 and the new passenger 213, is not discounted, while the cumulative waiting time 221 of the future passengers 214 is discounted.

Furthermore, an objective of the scheduling process 200 is to minimize an average waiting time, and not the cumulative waiting time over some interval. For the purposes of optimization, the two measures are interchangeable only when the time intervals for all possible decisions are equal.

In general, this is not the case. The landing pattern does not have the same duration for each car. Therefore, the scheduling process 200 has to average waiting times from their cumulative counterparts.

Obtaining the average expected waiting time 211 of existing passengers $\overline{W}_i$ 11–113 from the cumulative waiting time $W_i$ is straightforward. The number N of existing passengers 11–113 is always known by the scheduler and does not depend on the candidate car number i, so $\overline{W}_i=W_i/N$. On the other hand, obtaining the average waiting time 221 of future passengers $\overline{V}_i$ 214 from the cumulative discounted waiting time $V_i\beta$ over the duration of a landing pattern 219 is not as obvious.

The duration $T_C$ of the landing pattern is known. If the arrival rate at the main floor is $\lambda$, then the expected number of arrivals within $T_C$ time units is $\lambda T_C$. However, dividing $V_i$ by $\lambda T_C$ is meaningless, because $V_i$ has been discounted at a discount rate $\beta$.

Instead, the discount factor $\exp(-\beta t)$ is an averaging weight for time t. If n(t) is the expected momentary number of passengers arriving at time t, as reflected in the costs of the Markov model, then $V_i\beta=\int_0^{T_C}e^{\beta t}(t)dt$ means the expected cumulative weighted number of passengers arriving during the time interval $[0, T_C]$. Therefore, the quantity $\overline{n}=\int_0^{T_C}e^{\beta t}n(t)dt/\int_0^{T_C}e^{\beta t}dt$ is the expected average number of future passengers arriving within this interval, properly normalized by the integral sum of all weight factors. Furthermore, Little's law specifies that $n=\lambda\overline{V}_1$, see Cassandras et al., "*Introduction to discrete event systems*," Kluwer Academic Publishers, Dordrecht, The Netherlands, 1999. This finally yields the time-normalized expected wait of future passengers 221 $\overline{V}_i=V_i^{\beta}\beta/(\lambda-\lambda e^{-\beta t})$.

Having obtained comparable estimates $\overline{W}_i$ 211 and $\overline{V}_i$ 221 of the waiting times of existing and future passengers, these waiting times are combined 230 into a single adjusted waiting time 2231, for example by means of a weight $0\leqq\alpha\leqq1$, such that the adjusted waiting time is $\alpha\overline{W}_i+(1-\alpha)\overline{V}_i$.

The balance between existing and future waits depends on how quickly the system can free itself of present constraints by delivering passengers.

Thus the optimal value of $\alpha$ can be determined empirically based on physical operating characteristics of the elevator system. We find that weight values in the interval [0.1, 0.3] stably produce acceptable results, regardless of the height of the building and number of shafts.

Effect of the Invention

The system and method as described herein can significantly reduce waiting time with respect to the conventional scheduling processes, with savings in the range of 5%–55%. These improvements are attributed to the look-ahead policy for future passengers. Elevator performance in up-peak traffic typically determines the number of shafts a building needs. Using standard guidelines for fitting elevators in a building, the invention can often reduce the number of required shafts for mid- and high-rise office buildings by one, while still providing superior service. For a medium sized building, e.g., 25–30 floors, the cost per elevator can be about $200,000. Eliminating a shaft not only reduces the cost of the building but also the cost of maintenance, while increasing usable floor space.

Although the invention has been described by way of examples of preferred embodiments, it is to be understood that various other adaptations and modifications may be made within the spirit and scope of the invention. Therefore, it is the object of the appended claims to cover all such variations and modifications as come within the true spirit and scope of the invention.

We claim:

1. A method for scheduling a plurality of cars of an elevator system in a building, comprising:

receiving a call;

determining, for each car, based on future states of the elevator system, a first waiting time for all existing passengers if the car is assigned to service the call;

determining, for each car, based on a landing pattern for a near future time interval of the plurality of cars, a second waiting time of future passengers if the car is assigned to service the call, and in which the near future time interval is an average time it takes the plurality of cars to make a round trip from a main floor of the building and back;

combining, for each car, the first and second waiting times to produce an adjusted waiting time; and assigning a particular car having a lowest adjusted waiting time to service the call and to minimize an average waiting time of all passengers.

2. The method of claim 1 wherein the existing passengers include riding passengers in the plurality of cars having known arrival times, arrival floors, and destination floors, waiting passengers assigned to the plurality of cars having known arrival times, arrival floors and directions of travel, and a new passenger signaling the call, and all passengers include the existing and future passengers.

3. The method of claim 1 wherein the determining of the first waiting time further comprises:

evaluating a cost function to determine a cost for each future state; and assigning a particular car associated with a set of states having a least cost.

4. The method of claim 1 wherein a substantial number of the future passengers arrive at a selected floor during an up-peak traffic period.

5. The method of claim 1 wherein the landing pattern of elevator cars at a selected floor is a vector-valued random variable T with a probability distribution P(T), $T \in T$ over a space of all possible landing patterns T.

6. The method of claim 5 wherein all possible landing patterns depend on landing times of the plurality of cars.

7. The method of claim 4 wherein future passengers arrive at the main floor according to a Poisson process with a rate $\lambda$.

8. The method of claim 4 or 5, in which the selected floor is a main floor of the building.

9. The method of claim 1 wherein the landing pattern for a far future time interval t is discounted by $\exp(-\beta t)$, where $\beta>0$ is a discounting factor.

10. The method of claim 1 wherein the landing pattern is modeled by a semi-Markov chain having a plurality of states and transitions.

11. The method of claim 1 wherein the first waiting time W and second waiting time V are combined according to $\alpha W+(1-\alpha)V$, where $\alpha$ is a weight in a range $0 \leqq \alpha \leqq 1$.

12. The method of claim 11 wherein an optimal weight $\alpha$ is in an interval [0.1, 0.3].

13. An elevator scheduler for scheduling a plurality of cars of an elevator system in a building, comprising:

means for receiving a call;

means for determining, for each car, based on future states of the elevator system, a first waiting time for all existing passengers if the car is assigned to service the call;

means for determining, for each car, based on a landing pattern for a near future time interval of the plurality of cars, a second waiting time of future passengers if the car is assigned to service the call, and in which the near future time interval is an average time it takes the plurality of cars to make a round trip from a main floor of the building and back;

combining, for each car, the first and second waiting times to produce an adjusted waiting time; and assigning a particular car having a lowest adjusted waiting time to service the call and to minimize an average waiting time of all passengers.

* * * * *